US005855078A

United States Patent [19]

Starker

[11] Patent Number: 5,855,078

[45] Date of Patent: Jan. 5, 1999

[54] FOOTWEAR PROTECTOR

[76] Inventor: Ted Starker, 6020 S. Tamiami Trail, Sarasota, Fla. 34231

[21] Appl. No.: 908,364

[22] Filed: Aug. 7, 1997

[51] Int. Cl.[6] ..... A43B 5/14; A43B 5/18

[52] U.S. Cl. ..... 36/72 R; 36/131; 36/132

[58] Field of Search ..... 36/1.5, 72 R, 73, 36/132, 136, 131

[56] References Cited

U.S. PATENT DOCUMENTS

| | | | |
|---|---|---|---|
| 2,267,253 | 12/1941 | Ream | 36/72 R |
| 2,872,745 | 2/1959 | Finegan | 36/72 R |
| 3,006,086 | 10/1961 | Bird, Jr. | 36/72 R |
| 3,102,347 | 9/1963 | Griswold et al. | 36/72 R |
| 3,108,386 | 10/1963 | MacQuaid | 36/72 R |
| 3,175,292 | 3/1965 | MacQuaid et al. | 36/72 R |
| 3,271,888 | 9/1966 | Graham et al. | 36/72 R |
| 4,638,574 | 1/1987 | Roda | 36/72 R |
| 4,991,318 | 2/1991 | Cornell | 36/72 R |
| 5,168,644 | 12/1992 | Ellis | 36/72 R |
| 5,251,386 | 10/1993 | Diaz | 36/1.5 |
| 5,313,719 | 5/1994 | Koethe | 36/72 R |
| 5,457,898 | 10/1995 | Fortin et al. | 36/72 R |
| 5,566,476 | 10/1996 | Bertrand et al. | 36/72 R |
| 5,638,614 | 6/1997 | Hardy | 36/72 R |

FOREIGN PATENT DOCUMENTS

| | | | |
|---|---|---|---|
| 1397989 | 12/1965 | France | 36/72 R |

*Primary Examiner*—Paul T. Sewell
*Assistant Examiner*—Anthony Stashick
*Attorney, Agent, or Firm*—Joseph N. Breaux

[57] ABSTRACT

A footwear protector for motorcyclists. The footwear protector includes a leather shoe cover including a loop portion and a curved bill portion, the loop portion having at least two centrally positioned strap securing loops and one buckle securing loop formed thereon; an elongated flexible securing strap including a tip end and a buckle end, the tip end being threaded sequentially through the buckle securing loop in a direction away from the at least two centrally positioned strap securing loops, and then through each of the centrally positioned strap securing loops in a direction toward the buckle securing loop beginning with the strap securing loop positioned farthest away from the buckle securing loop, the buckle end including a buckle assembly securable to the securing strap in a manner to form at least one closed loop; a resilient plastic shift lever contact section stitched to the curved bill portion of the leather shoe cover in a manner to form a compartment; and a curved protective metal plate positioned within the compartment formed between the resilient plastic shift lever contact section and the curved bill portion of the leather shoe cover.

18 Claims, 2 Drawing Sheets

FOOTWEAR PROTECTOR

TECHNICAL FIELD

The present invention relates to footwear protector devices that prevent damage to shoes, boots, etc. and more particularly to a footwear protector for protecting the footwear of a motorcyclist that includes a leather shoe cover including a loop portion and a curved bill portion, the loop portion having at least two centrally positioned strap securing loops and one buckle securing loop formed thereon; an elongated flexible securing strap including a tip end and a buckle end, the tip end being threaded sequentially through the buckle securing loop in a direction away from the at least two centrally positioned strap securing loops, and then through each of the centrally positioned strap securing loops in a direction toward the buckle securing loop beginning with the strap securing loop positioned farthest away from the buckle securing loop, the buckle end including a buckle assembly securable to the securing strap in a manner at form at least one closed loop; a resilient plastic shift lever contact section stitched to the curved bill portion of the leather shoe cover in a manner to form a compartment; and a curved protective metal plate positioned within the compartment formed between the resilient plastic shift lever contact section and the curved bill portion of the leather shoe cover.

BACKGROUND OF THE INVENTION

Motorcycles typically have a shift lever that is operated by the foot of the motorcyclist. Although this provides a convenient shifting modality, the use of this shifting mechanism often results in damage to the top shell portion of the footwear worn by the motorcyclist. It would be a benefit, therefore, to have a footwear protector that could be worn by a motorcyclist to protect the top shell of footwear articles such as boots, shoes and the like that could be easily transferred between footwear articles. Because the foot protector is to be worn over the top shell of the footwear article it would also be a benefit to have a footwear protector that included a footwear contact surface that would not abrade or otherwise damage the top shell of the footwear article upon which it is worn. Because the shift lever can require considerable force to move between the gear positions, it would of course also be desirable to have a footwear protector that included a rigid protector plate. It would of course also be desirable to have a footwear protector device for motorcyclists that included a resilient shift lever contact section to minimize slipping between the footwear protector and the shift lever of the motorcycle during operation of the motorcycle and shifting of the shift lever.

SUMMARY OF THE INVENTION

It is thus an object of the invention to provide a footwear protector that is easily positionable onto the footwear article of a motorcyclists to protect the top shell of footwear articles such as boots, shoes and the like.

It is a further object of the invention to provide a footwear protector that includes a footwear contact surface that is constructed from a non-abrading material such as leather.

It is a still further object of the invention to provide a footwear protector that includes a rigid protector plate.

It is a still further object of the invention to provide a footwear protector that includes a resilient shift lever contact section to minimize slipping between the footwear protector and the shift lever of a motorcycle during operation of the motorcycle.

It is a still further object of the invention to provide a footwear protector that includes a leather shoe cover including a loop portion and a curved bill portion, the loop portion having at least two centrally positioned strap securing loops and one buckle securing loop formed thereon; an elongated flexible securing strap including a tip end and a buckle end, the tip end being threaded sequentially through the buckle securing loop in a direction away from the at least two centrally positioned strap securing loops, and then through each of the centrally positioned strap securing loops in a direction toward the buckle securing loop beginning with the strap securing loop positioned farthest away from the buckle securing loop, the buckle end including a buckle assembly securable to the securing strap in a manner to form at least one closed loop; a resilient plastic shift lever contact section stitched to the curved bill portion of the leather shoe cover in a manner to form a compartment; and a curved protective metal plate positioned within the compartment formed between the resilient plastic shift lever contact section and the curved bill portion of the leather shoe cover.

It is a still further object of the invention to provide a footwear protector that accomplishes some or all of the above objects in combination.

Accordingly, a footwear protector for motorcyclists is provided. The footwear protector includes a leather shoe cover including a loop portion and a curved bill portion, the loop portion having at least two centrally positioned strap securing loops and one buckle securing loop formed thereon; an elongated flexible securing strap including a tip end and a buckle end, the tip end being threaded sequentially through the buckle securing loop in a direction away from the at least two centrally positioned strap securing loops, and then through each of the centrally positioned strap securing loops in a direction toward the buckle securing loop beginning with the strap securing loop positioned farthest away from the buckle securing loop, the buckle end including a buckle assembly securable to the securing strap in a manner to form at least one closed loop; a resilient plastic shift lever contact section stitched to the curved bill portion of the leather shoe cover in a manner so form a compartment; and a curved protective metal plate positioned within the compartment formed between the resilient plastic shift lever contact section and the curved bill portion of the leather shoe cover.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

DESCRIPTION OF THE EXEMPLARY EMBODIMENT

Figure 1:
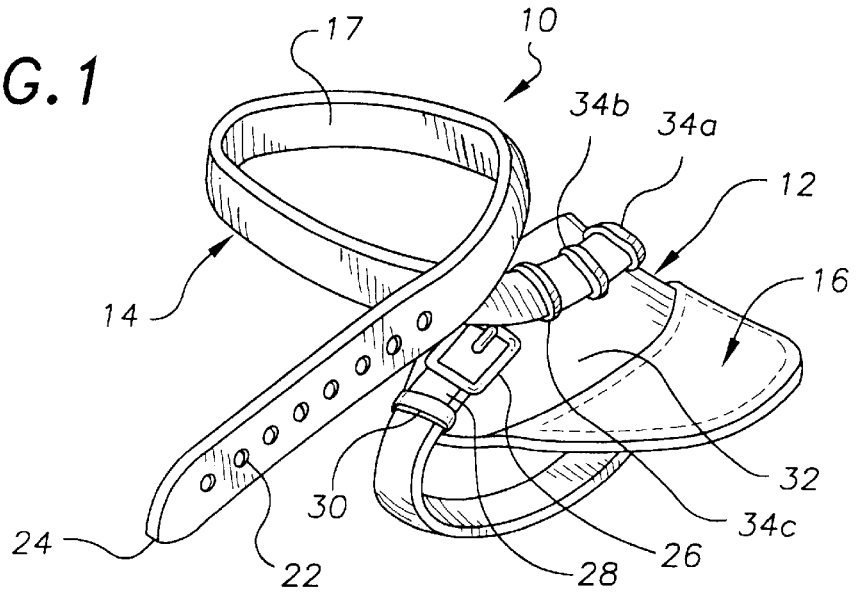
FIG. 1 is a perspective view of an exemplary embodiment of the footwear protector of the present invention showing the leather shoe cover including loop portion and the curved bill portion, the loop portion having the three central strap securing loops and the single buckle securing loop formed thereon; the elongated flexible leather securing strap Including a tip end and a buckle end, the tip end being threaded sequentially through the buckle securing loop in a direction away from the three central strap securing loops, and then through each of the central strap securing loops beginning with the central strap securing loop positioned farthest away from the buckle securing loop; and the resilient plastic shift lever contact section stitched to the curved bill portion of the leather shoe cover in a manner to form a compartment containing a protective metal plate.

FIG. 1 shows an exemplary embodiment of the footwear protector of the present invention, generally designated by The numeral 10. Footwear protector 10 includes a leather shoe cover, generally designated 12; an elongated flexible leather securing strap assembly, generally designated 14; a resilient plastic shift lever contact section, generally designated 16; and a curved protective aluminum plate, generally designated 18 (FIG. 3. In this embodiment, leather strap assembly 14 includes a single length of leather strapping 17 having a number of securing apertures 22 formed through a tip end 24 thereof and a conventional buckle assembly 26 provided at a buckle end 28. During assembly, tip end 24 is threaded through a buckle securing loop 30 formed along a side edge of a top portion 32 of leather shoe cover 12 and pulled through until buckle assembly 26 is positioned adjacent to buckle securing loop 30. Tip end 24 is then looped beneath leather shoe cover 12 and then inserted sequentially through each of three centrally positioned strap securing loops 34*a*,34*b*,34*c*.

Figure 2:
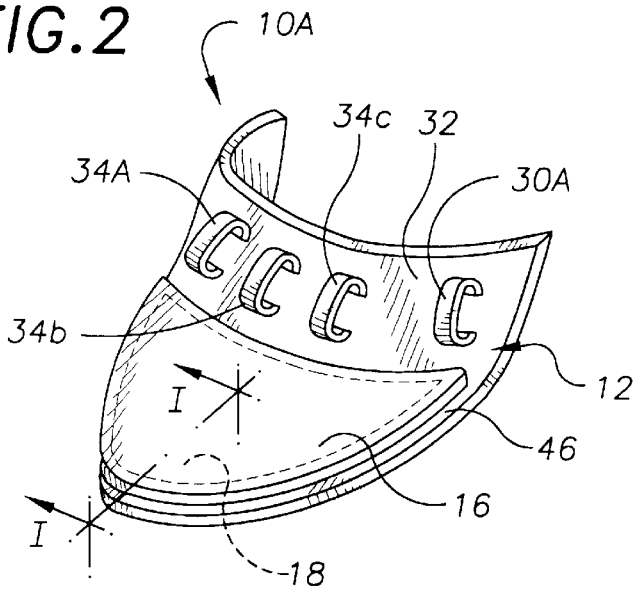
FIG. 2 is a perspective view of a second exemplary footwear protector that is a mirror image of the exemplary footwear protector of FIG. 1 with the elongated flexible leather securing strap removed to more clearly show the leather shoe cover including the loop portion including the three central strap securing loops and the single buckle securing loop, and the curved bill portion; and the resilient plastic shift lever contact section stitched to the curved bill portion of the leather shoe cover.

With reference now to FIG. 2, a second embodiment of the footwear protector is shown and generally designated by the designation 10A. Footwear protector 10A is a mirror image of footwear protector 10 and includes a buckle securing loop 30A that is formed on the opposite side of top portion 32 of leather shoe cover 12 than buckle securing loop 30 (FIG. 1) and the positioning of central strap securing loops 34*a*,34*b*,34*c* is reversed.

Figure 3:
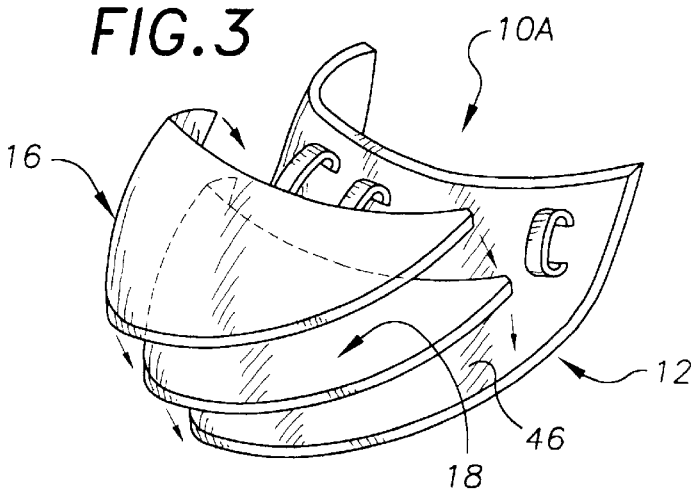
FIG. 3 is a partially exploded view showing the resilient plastic shift lever contact section unattached to the curved bill portion of the leather shoe cover; the curved protective aluminum plate; and the curved bill portion of the leather shoe cover.
Figure 4:
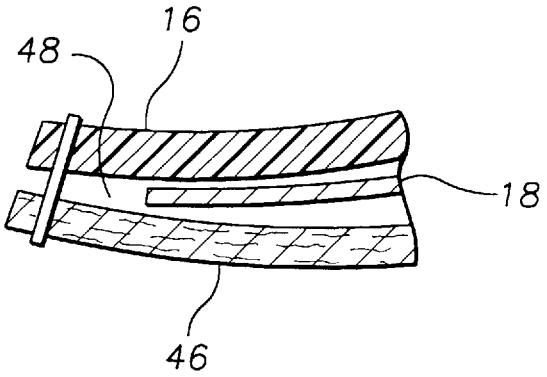
FIG. 4 is a cross sectional view along the line I—I of FIG. 1 showing the plastic shift lever contact section stitched to the curved bill portion of the leather shoe cover to form a compartment and the curved protective metal plate positioned within the compartment.

With reference to FIG. 3, resilient plastic shift lever contact section 16 is positioned over curved aluminum plate 18. Curved alumina plate 18 is then Positioned onto the curved tapered bill portion 46 of leather shoe cover 12 and, with reference to FIG. 4, plastic shift lever contact section 16 is then stitched around its perimeter to curved tapered bill portion 46 in a manner such hat curved aluminum plate 18 is secured within a compartment 48 formed between plastic shift lever contact section 16 and curved tapered bill portion 46.

Figure 5:
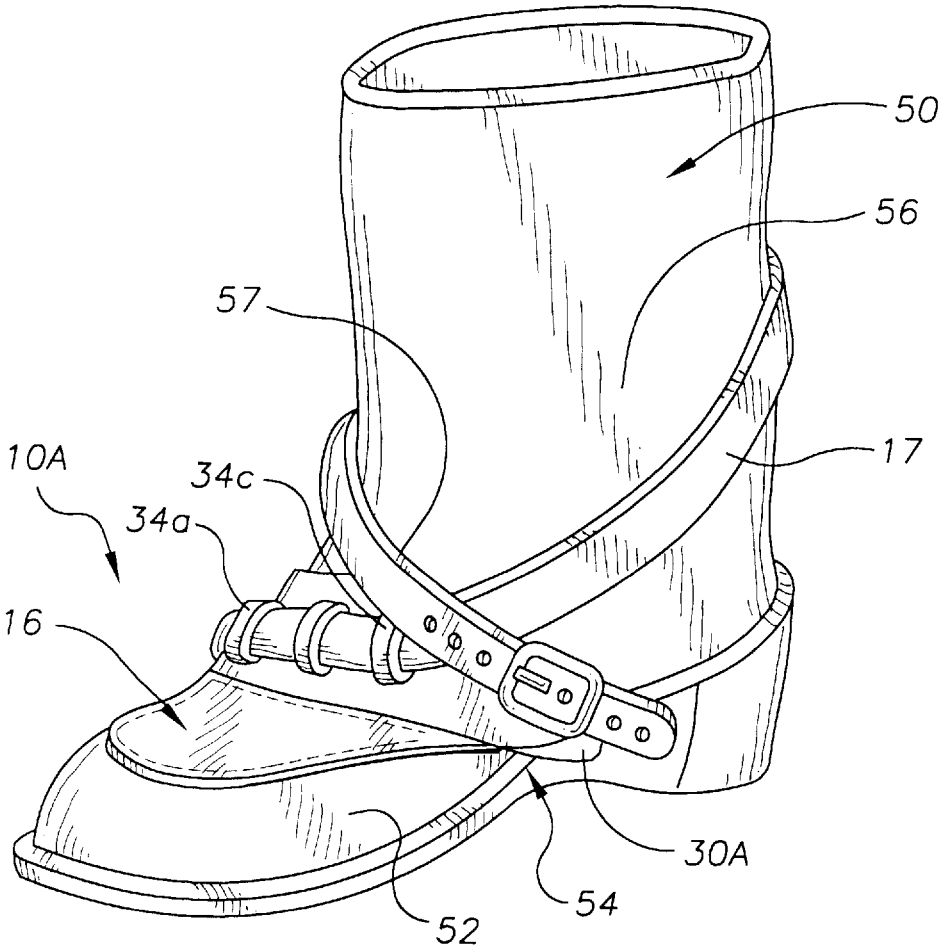
FIG. 5 is a perspective view of the exemplary footwear protector of FIG. 2 with the elongated flexible leather securing strap threaded through the buckle securing loop and the three central strap securing loops in a manner to form a first closed securing loop around the instep portion of a representative boot and a second closed securing loop about the lower leg portion of the representative boot.

With reference now to FIG. 5, footwear protector 10A is installed onto a representative boot 50 by inserting the toot receiving portion 52 of boot 50 through a first closed securing loop, generally designated 54, formed by a section of securing strap 17 positioned between buckle securing loop 30*a* and centrally positioned strap securing loop 34a and securing the leg receiving portion 56 of boot 50 within a second closed loop, generally designated 57, formed by section of strap 17 positioned between centrally positioned strap securing loop 34*c* and buckle securing loop 30*a*. In use, resilient plastic shift lever contact section 16 contacts the shift lever of the motorcycle while the non-abrasive leather of curved tapered bill portion 46 (FIG. 3) contacts the top shell of foot receiving portion 52 of boot 50.

It can be seen from the preceding description that a footwear protector has been provided that is easily positionable onto the footwear article of a motorcyclists to protect the top shell of footwear articles such as boots, shoes and the like; that includes a footwear contact surface that is constructed from a non-abrading material such as leather; that includes a rigid protector plate; that includes a resilient shift lever contact section to minimize slipping between the footwear protector and the shift lever of a motorcycle during operation of the motorcycle; and that includes a leather shoe cover including a loop portion and a curved bill portion, the loop portion having at least two centrally positioned strap securing loops and one buckle securing loop formed thereon; an elongated flexible securing strap including a tip end and a buckle end, the tip end being threaded sequentially through the buckle securing loop In a direction away from the at least two centrally positioned strap securing loops, and then through each of the centrally positioned strap securing loops in a direction toward the buckle securing loop beginning with the strap securing loop positioned farthest away from the buckle securing loop, the buckle end including a buckle assembly securable to the securing strap in a manner to form at least one closed loop; a resilient plastic shift lever contact section stitched to the curved bill portion of the leather shoe cover in a mariner to form a compartment; and a curved protective metal plate positioned within the compartment formed between the resilient plastic shift lever contact section and the curved bill portion of the leather shoe cover.

It is noted that the embodiment of the footwear protector described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A footwear protector comprising:

a shoe cover including a loop portion and a curved bill portion, said loop portion having at least two centrally positioned strap securing loops and one buckle securing loop formed thereon;

an elongated flexible securing strap including a tip end and a buckle end, said tip end being threaded sequentially through said buckle securing loop in a direction away from said at least two centrally positioned strap securing loops, and then through each of said centrally positioned strap securing loops in a direction toward said buckle securing loop beginning with said strap securing loop positioned farthest away from said buckle securing loop, said buckle end including a buckle assembly securable to said securing strap in a manner to form at least one closed loop;

a resilient shift lever contact section stitched to said curved bill portion of said shoe cover in a manner to form a compartment; and a curved protective metal plate positioned within said compartment formed between said resilient shift lever contact section and said curved bill portion of said shoe cover.

2. The footwear protector of claim 1, wherein:

said shoe cover is constructed of leather.

3. The footwear protector of claim 1, wherein:

said elongated flexible securing strap is constructed of leather.

4. The footwear protector of claim 1 wherein:

said shoe cover includes three centrally positioned strap securing loops.

5. The footwear protector of claim 1 wherein:

said curved protective metal plate is constructed of aluminum.

6. The footwear protector of claim 1 wherein:

said resilient shift lever contact section is constructed of a resilient elastic.

7. The footwear protector of claim 2, wherein:

said elongated flexible securing strap is constructed of leather.

8. The footwear protector of claim 2 wherein:

said shoe cover includes three centrally positioned strap securing loops.

9. The footwear protector of claim 2 wherein:

said curved protective metal plate is constructed of aluminum.

10. The footwear protector of claim 2 wherein:

said resilient shift lever contact section is constructed of a resilient plastic.

11. The footwear protector of claim 7 wherein:

said shoe cover includes three centrally positioned strap securing loops.

12. The footwear protector of claim 7 wherein:

said curved protective metal plate is constructed of aluminum.

13. The footwear protector of claim 7 wherein:

said resilient shift lever contact section is constructed of a resilient plastic.

14. The footwear protector of claim 11 wherein:

said curved protective metal plate is constructed of aluminum.

15. The footwear protector of claim 11 wherein:

said resilient shift lever contact section is constructed of a resilient plastic.

16. The footwear protector of claim 14 wherein:

said resilient shift lever contact section is constructed of a resilient plastic.

17. The footwear protector of claim 8 wherein:

said curved protective metal plate is constructed of aluminum.

18. The footwear protector of claim 8 wherein:

said resilient shift lever contact section is constructed of a resilient plastic.

* * * * *